US006688066B1

(12) United States Patent
Cottier et al.

(10) Patent No.: US 6,688,066 B1
(45) Date of Patent: Feb. 10, 2004

(54) CONSTRUCTION TECHNIQUE AND STRUCTURE RESULTING THEREFROM

(75) Inventors: John Sydney Cottier, Oatley (AU); James Graham Geeves, deceased, late of Baulkham Hills (AU), Kay Geeves legal representative

(73) Assignee: James Hardie Research Pty Limited, Rosehill (AU)

( * ) Notice: Subject to any disclaimer, the term of this patent is extended or adjusted under 35 U.S.C. 154(b) by 0 days.

(21) Appl. No.: 09/786,618

(22) PCT Filed: Aug. 6, 1999

(86) PCT No.: PCT/AU99/00639

§ 371 (c)(1),
(2), (4) Date: Oct. 5, 2001

(87) PCT Pub. No.: WO00/14354

PCT Pub. Date: Mar. 16, 2000

(30) Foreign Application Priority Data

Sep. 2, 1998 (AU) ..... PP5667

(51) Int. Cl.[7] ..... E04B 2/58

(52) U.S. Cl. ..... 52/481.1; 52/733.2; 52/742.14; 52/426

(58) Field of Search ..... 52/481.1, 731.9, 52/731.5, 729.5, 733.2, 733.3, 742.14, 745.09, 426, 427, 428, 431

(56) References Cited

U.S. PATENT DOCUMENTS

| | | | | |
|---|---|---|---|---|
| 2,681,127 A | * | 6/1954 | Baker | 52/363 |
| 3,066,772 A | * | 12/1962 | Gibson | 52/364 |

(List continued on next page.)

FOREIGN PATENT DOCUMENTS

| | | | | |
|---|---|---|---|---|
| AU | AU-B-52074/93 | | 11/1993 | |
| CA | 1 139 075 | | 1/1983 | |
| DE | 2313041 A | * | 10/1973 | 52/732.3 |
| DE | 2459421 A1 | * | 6/1976 | 52/729.5 |
| FR | 2 559 523 | | 2/1984 | |
| GB | 866234 | | 4/1961 | |
| JP | 59-500136 | | 1/1984 | |
| JP | 2-115437 | | 4/1990 | |
| JP | 8-74358 | | 3/1996 | |
| JP | 52-22599 | | 2/1997 | |
| NL | 275243 B | * | 10/1964 | 52/481.1 |
| WO | WO 90/01091 | | 2/1990 | |
| WO | WO 98/09035 | | 3/1998 | |

OTHER PUBLICATIONS

PCT International Search Report.

Australian Patent Office International–Type Search Report.

*Primary Examiner*—Brian E. Glessner
(74) *Attorney, Agent, or Firm*—Knobbe, Martens, Olson & Bear, LLP

(57) ABSTRACT

A method of construction of partitions (1) including the steps of erecting a structural steel frame from spaced apart frame members (2, 3), the frame members having boxed mounting flanges (4, 6) and being formed from a metal having a relatively high tensile strength, applying at least one layer of sheet material (11) to at least one side of the frame, and securing the layer of sheet material (11) to the frame by means of self-piercing impact fasteners (12). In one preferred form, staples (51) are used to secure cladding sheets (52) to boxed flange frame members for various dry wall constructions. In another preferred embodiment, staples (51) or nails (12) are similarly used to secure layers of sheet material (11, 52) to opposing sides of the frame to define an intermediate cavity which is subsequently filled with cementitious material to form a solid partition.

59 Claims, 5 Drawing Sheets

U.S. PATENT DOCUMENTS

| | | | | | |
|---|---|---|---|---|---|
| 3,333,390 | A | * | 8/1967 | Banning | 52/355 |
| 3,344,572 | A | * | 10/1967 | Sell | 52/520 |
| 3,925,955 | A | * | 12/1975 | Becht | 411/472 |
| 3,996,714 | A | | 12/1976 | Hazelett, Jr. | |
| RE29,965 | E | * | 4/1979 | Zinn | 52/243 |
| 4,638,615 | A | * | 1/1987 | Taylor | 52/364 |
| 4,648,228 | A | * | 3/1987 | Kiselewski | 52/426 |
| 5,279,091 | A | * | 1/1994 | Williams et al. | 52/241 |
| 5,454,199 | A | | 10/1995 | Blom et al. | |
| 5,493,837 | A | * | 2/1996 | Hepler | 52/363 |
| 5,557,898 | A | * | 9/1996 | Dixon | 411/450 |
| 5,819,489 | A | * | 10/1998 | McKinney | 52/309.11 |
| 6,115,986 | A | * | 9/2000 | Kelly | 52/634 |
| 6,397,550 | B1 | * | 6/2002 | Walker et al. | 52/653.1 |
| 6,415,576 | B1 | * | 7/2002 | Stromback | 52/719 |
| 6,436,552 | B1 | * | 8/2002 | Walker et al. | 428/598 |

* cited by examiner

CONSTRUCTION TECHNIQUE AND STRUCTURE RESULTING THEREFROM

FIELD OF THE INVENTION

The present invention relates generally to building construction techniques and more particularly to methods of constructing building partitions such as walls, ceilings and the like. The invention has been developed primarily for use in wall construction and will be described herein with reference to this use. However, it will be appreciated that the invention can be applied to other similar structures such as floors, ceilings and fences etc.

BACKGROUND OF THE INVENTION

In conventional modern housing construction, walls are generally fabricated by first erecting a structural frame, which is typically formed from timber. The frame is lined internally with a suitable lining material such as plaster board or fibre reinforced cement sheeting, which is subsequently finished to conceal joints and finally painted. The external wall is traditionally formed from brick veneer or masonry which provides the advantages of strength, durability and resistance to adverse weather conditions in a relatively cost effective manner. A particular advantage of masonry construction is the look and feel of solidity, which many home owners find desirable.

In the past, alternative external cladding materials have also been used. These include timber weatherboards, roll formed aluminium panels, as well as fibre reinforced cement sheets, planks and boards in various surface textures and finishes. These materials have been found to be generally competitive with brick veneer construction on a cost basis. However, a major disadvantage is that such cladding materials do not exhibit the same strength, impact resistance, and feel of solidity as masonry. In particular, they produce a hollow "drummng" sound when knocked, which tends to convey a subjective perception of insubstantiality or flimsiness, notwithstanding the fact that the construction possesses adequate structural integrity in objective terms.

In an attempt to overcome this problem, it is known to construct wall sections by first forming a structural timber frame, erecting formwork around the frame, and filling the cavities around the frame members with mortar or concrete. The formwork is removed when the concrete has set sufficiently to be self-supporting, thereby providing a free standing structural wall formed substantially of concrete. The need for internal steel reinforcing may be obviated by the use of fibre reinforced cement cladding. In a variation on this method, permanent formwork can be made directly from fibre reinforced cement sheets.

While these techniques provide the desired feel of solidity and substantiality, they possess inherent disadvantages. The most significant problem is that because of the material costs, the relatively high labour content required, and the time involved, the technique is not cost effective in comparison with conventional masonry construction.

In an attempt to minimise the time involved in erecting the structural framework, as well as reducing material costs, it has been known to use steel framing elements, typically in the form of C-shaped channels, in domestic housing construction. It has been found, however, that conventional C-shaped steel framing sections exhibit a relatively low degree of torsional rigidity. Furthermore, it has been found that the fastening of internal lining and external cladding materials to steel framing elements of this type, can be problematic. In particular, if impact driven fasteners are used, there is a tendency for the flanges of the steel framing elements to bend inwardly, away from the facing sheet. This prevents penetration and secure engagement. The resultant buckling and warping, also reduces the structural strength and the dimensional accuracy of the framing structure. In such systems, it is therefore necessary to use self-drilling, self-tapping screws, which exert lower lateral forces on the framing elements during installation. However, this fastening technique is time consuming and expensive relative to impact driven fastener nails.

In an attempt to overcome some of these problems, it is known to produce steel framing members having boxed edge flanges. These are generally more resistant to bending in response to the application of lateral forces and exhibit greater torsional rigidity. However, while these conventional box flanged steel studs theoretically possess sufficient strength and rigidity to withstand fastening of cladding sheets with self piercing impact fasteners such as nails, the holes pierced by the fastener tend to be at least the same diameter as, and often marginally larger than, the fastener themselves. As a consequence, the pull-out strength of the joint is usually inadequate. Accordingly, the requirement for fastening of cladding sheets or boards by means of screws remains as a relatively time consuming and labour intensive part of the construction process.

Similar comments apply in respect of steel stud framing dry wall systems which are used primarily in the construction of commercial building to produce internal partition walls. In such wall structures, sheet cladding materials are secured, generally by the use of self-drilling, self-tapping screws, to internal steel stud wall frames. Thermal and/or acoustic insulating materials may also be provided within the cavity and single or multiple external layers of different sheet materials are used depending on the performance characteristics required for different applications. For example, where a fire rating is required, a gypsum wall board product will usually be incorporated, and where a hard abrasion resistant material is required the cladding may include a fibre reinforced cement sheeting such as the Villaboard™ product produced by the applicant company.

As with the previously described solid composite wall structures, the screw fastening of the cladding materials to the metal studs makes the construction process very expensive due both to the material cost of the self-drilling, self-tapping screws and the time taken to assemble the structure using such fasteners.

It is an object of the present invention to overcome or substantially ameliorate at least some of the disadvantages of the prior art, or to provide a useful alternative.

DISCLOSURE OF THE INVENTION

Accordingly, in its broadest form the invention provides a method of partition construction, said method including the steps of erecting a support frame from spaced apart frame members having boxed mounting flanges, the frame members being formed from a metal having a relatively high tensile strength, applying a layer of sheet material to at least one side of the frame, and securing said layer of sheet material to the frame by means of self-piercing impact fasteners.

The term "partition" is used herein to include within its meaning structural load bearing or non-load bearing partitions including walls, floors and ceilings etc.

In the preferred embodiment, the frame members include studs each having spaced apart closed boxed mounting flanges joined by an intermediate web section. In other embodiments, the studs may be constructed from simple box sections without an intermediate web and as such may-include standard square, rectangular or other hollow sections. Preferably such sections are modified to include two or more layers adjacent the mounting flanges.

Desirably, the frame members having boxed mounting flanges are configured to enable suitably sized self-piercing impact fasteners to penetrate two adjacent but spaced external and internal surfaces of the frame member. Preferably, the external surface of the frame member is configured to extend transverse to the direction of penetration of the self piercing impact fastener and the internal surface is inclined thereto. In this manner penetration of the fastener through the two layers enables the effect of the resilience of the high tensile material to be enhanced to further grip the impact fastener.

In one preferred form of the invention, the frame member has what is commonly referred to as a "dog bone" section as illustrated in the accompanying examples. In another preferred form, the frame member is similar to a standard Z-section member but includes closed-in outer box sections will also be described hereafter.

In preferred wall applications the frame members or studs are vertically oriented, and are joined by generally horizontal or inclined connecting members. Preferably, the connecting members include generally channel shaped top plates, and bottom plates.

Desirably, the frame members are between 50 mm and around 200 mm in width, and ideally about 70 mm to 90 mm in width, corresponding to the distance between the flanges and hence the thickness of the wall cavity. The stud spacing is preferably 300 mm to 600 mm centres and ideally around 400 mm centres.

In one preferred form of the invention, the self-piercing impact fasteners comprise nails which are preferably applied using a powered nail gun or driver. In another preferred form, a two-pronged self piercing impact fastener with bridging member, such as a staple, is used. The staple may be configured to penetrate one or more layers of the frame member. The staple may have the parallel prongs that extend transversely to the bridging member or may be configured to diverge on penetration. Desirably, the staples are also applied by use of a powered gun or driver.

In a first preferred application of the invention there is provided a method of construction of a solid filled partition, said method including the steps of erecting a support frame from spaced apart frame members having boxed mounting flanges, the frame members being formed from a metal having a relatively high tensile strength, applying an internal layer of sheet material to an inner side of the frame, applying an external layer of sheet material to an outer side of the frame, securing said internal and external layers of sheet material to the frame by means of self-piercing impact fasteners, and filling the wall cavity with a cementitious material.

Preferably, the frame member is of a structure in accordance with any one of the preferred forms outlined above.

More preferably, the frame members are formed from a high tensile sheet steel having a thickness of between 0.2 mm and 1.2 mm, and ideally between 0.35 mm and 1 mm. Preferably, the frame members have a yield strength of between 400 MPa and 700 MPa, and ideally around 550 MPa.

Desirably, the cementitious material preferably includes additives selected to provide an overall core density of between 200 kg/m$^3$ and around 1200 kg/m$^3$, and ideally about 550 kg/m$^3$. Preferably, the cementitious material takes the form of a concrete formulation.

One preferred concrete formulation includes:

30% to 60% by weight of cement;

10% to 30% by weight of sand;

20% to 40% by weight of water;

1% to 10% by weight of expanded polystyrene beads; and

1% to 5% by weight of concrete additives.

It has been found that this composition produces the desired characteristics for the purpose in terms of pumpability, adequate stickiness and density, and acceptable cost.

Preferably, the cementitious material is applied by pumping or spraying.

In a preferred embodiment, the sheet material is a fibre reinforced cement sheet having a relatively low permeability. Alternatively, the sheet material may be a cement bonded particle board. In a preferred embodiment, a jointing compound is applied over abutting edges of adjacent sheets to conceal the joins.

In one preferred form the sheet material is secured to the frame members by self-piercing impact fasteners in the form of hardened nails that are ideally galvanised and have a knurled shank and which are preferably applied by a powered nail gun or driver. Sample wall specifications with cavity size, sheet specifications, nail specifications and nail spacing configurations are exemplified below.

TABLE A

| | |
|---|---|
| Sheet: | • Fibre reinforce sheeting such as Villaboard ™ or Hardiwall ™ .<br>• Thickness range from 4.5 mm to 12 mm but ideally 6 mm–9 mm.<br>• Alternatively Gypsum wall board with sheet thickness range from 10 mm to 16 mm.<br>• All sheets to have the long edges recessed if the wall is to be flush jointed and set. |
| Framing: | • Boxed mounting flange stud ("Dogbone").<br>• Gauge between 0.2 and 1.2 and ideally 0.35 mm to 1 mm.<br>• Stud spacing 300 mm to 600 mm centres.<br>• Stud width between 64 mm and 200 mm but ideally 70 mm to 90 mm (stud width determines cavity size) |
| Fixing: | • Hardened steel nail with knurled shank (galvanised).<br>• Shank diameter 2 mm to 3.2 mm.<br>• Head diameter 5 mm to 10 mm.<br>• Length 25 mm to 50 mm.<br>• Fastener centres between 100 mm and 300 mm per stud but ideally at 150 mm centres. |
| Core Mix: | • Density between 200 and 1200 kg/m$^3$ and ideally about 550 kg/m$^3$ |

In another preferred form, the sheet material is secured to the frame members by means of staples which are preferably steel galvanised and which are preferably applied by a powered nail gun or driver. Sample wall specifications with cavity size, sheet specifications, staple specifications and staple spacing configurations are exemplified below.

TABLE B

| | |
|---|---|
| Sheet: | • Fibre reinforced sheeting such as Villaboard ™ Hardiwall ™ .<br>• Thickness range from 4.5 mm to 12 mm but ideally 6 mm–9 mm.<br>• Alternatively Gypsum wall board with sheet thickness range from 10 mm to 16 mm.<br>• All sheets to have the long edges recessed if the wall is to be flush jointed and set. |
| Framing: | • Boxed mounting flange stud ("Dogbone").<br>• Gauge between 0.2 and 1.2 and ideally 0.35 mm to 1 mm.<br>• Stud spacing 300 mm to 600 mm centres.<br>• Stud width between 64 mm and 200 mm but ideally 70 mm to 90 mm (stud width determines cavity size). |
| Fixing: | • Steel staples (galvanised).<br>• Crown width 5 mm to 20 mm<br>• Gauge 0.8 mm to 2 mm<br>• Length 25 mm to 50 mm<br>• Fastener centres between 100 mm and 300 mm per stud but ideally at 150 mm centres. |
| Core Mix: | • Density between 200 and 1200 kg/m$^3$ and ideally about 550 kg/m$^3$. |

In accordance with a second preferred application of the invention there is provided a method of dry wall construction, said method including the steps of erecting a support frame from spaced apart frame members having boxed mounting flanges, the frame members being formed from a metal having a relatively high tensile strength, applying a layer of sheet material to at least one side of the frame, and securing said layer of sheet material to the frame by means of impact driven staples.

Preferably, the frame members are configured in accordance with one of the preferred frame structures outlined above.

More preferably, the frame members are formed from a high tensile sheet steel having a thickness of between 0.2 mm and 1.2 mm, and ideally between 0.35 mm and 1 mm. Preferably, the frame members have a yield strength of between 400 MPa and 700 MPa, and ideally around 550 MPa.

In one embodiment, straight parallel pronged staples may be used. In other embodiments, staples having diverging prongs or tines may be used to increase the pull-out strength of the joint.

Desirably, the method includes the step of controlling the penetration depth of the staple through the outer surface of the sheet material to simplify any subsequent finishing process that may be required. For example with fibre rein staples are set to recess below the outer surface so that filling and finishing is a relatively simple low skill task.

Depending on the application, the method of construction may include the step of securing a further layer of sheet material to the opposite side of the frame. As required, the method may also include the step of securing additional layers of sheet materials such as paper clad gypsum board and fibre reinforced sheeting depending on the application. Typical sample specification are exemplified below.

TABLE C

| | |
|---|---|
| Sheet: | • Fire rated Gypsum board 10 mm to 16 mm in thickness fastened to frame and overlaid with 6 mm to 9 mm fibre reinforced cement sheeting.<br>• Joints between adjacent sheet layers are usually offset. |
| Framing: | • Boxed mounting flange stud ("Dogbone").<br>• Gauge between 0.2 and 1.2 and ideally 0.35 mm to 1 mm.<br>• Stud spacing 300 mm to 600 mm centres.<br>• Stud width between 64 mm and 200 mm but ideally 70 mm to 90 mm (stud width determines cavity size). |
| Fixing: | • Steel staples (galvanised); or<br>• Crown width 5 mm to 20 mm<br>• Gauge 0.8 mm to 2 mm<br>• Length 25 mm to 50 mm<br>• Hardened steel nail with knurled shank (galvanised).<br>• Shank diameter 2 mm to 3.2 mm.<br>• Head diameter 5 mm to 10 mm.<br>• Length 25 mm to 50 mm.<br>• Fastener centres between 100 mm and 300 mm per stud but ideally at 150 mm centres. |

In another aspect the invention provides a partition constructed in accordance with any one of the various methods outlined above.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
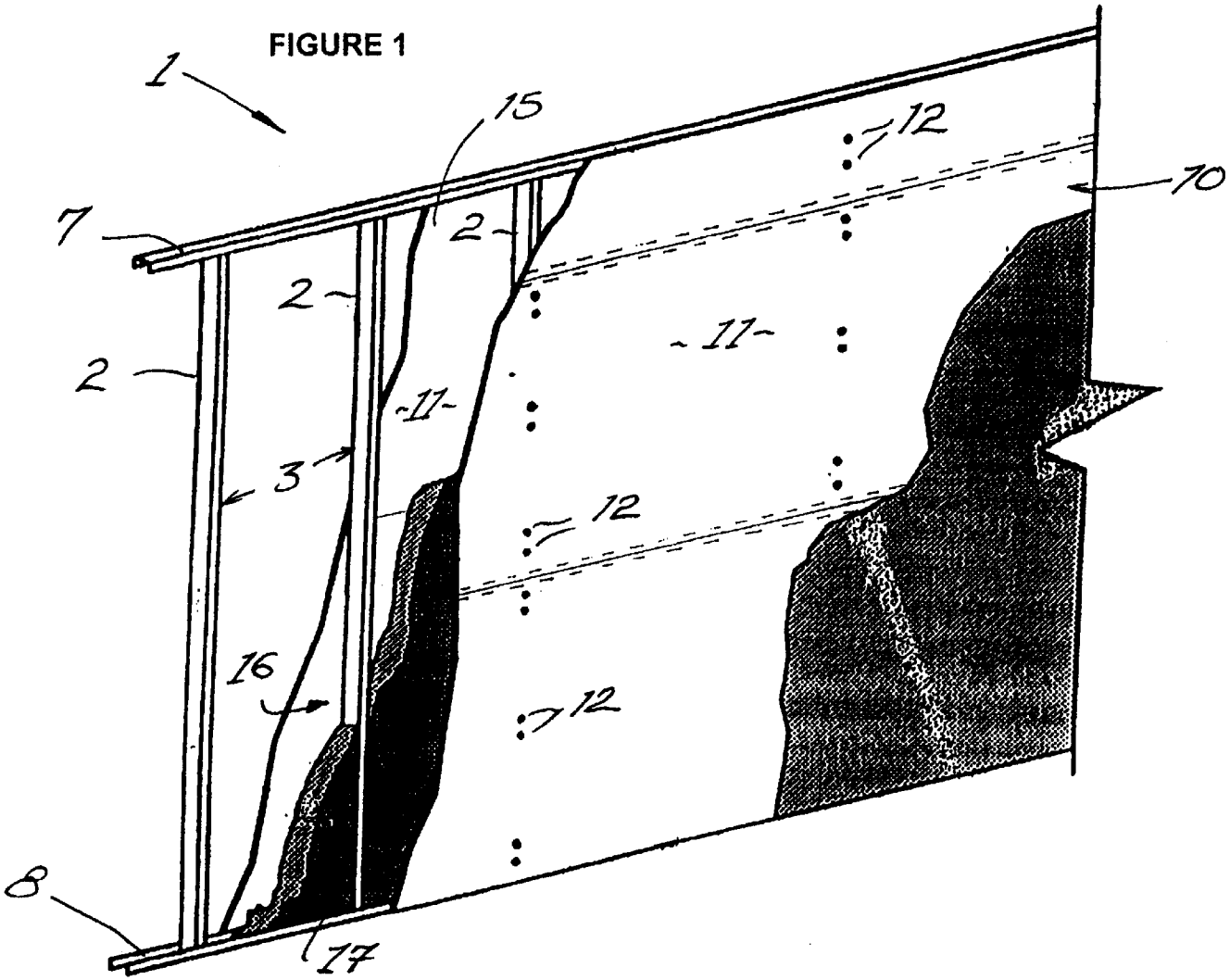
FIG. 1 is a cutaway perspective view showing a first embodiment solid filled wall section formed in accordance with the method of the first preferred application of the present invention.

Referring initially to FIG. 1, the invention provides a method of construction which is particularly well adapted to making a partition in the form of solid filled walls 1 in domestic or commercial dwellings. Initially, a structural frame is erected on a suitably prepared foundation using spaced apart frame members 2.

The frame members are formed from a relatively high tensile steel having a yield strength of between 400 MPa and around 700 MPa, and ideally about 550 MPa. Each framing element is fabricated from sheet metal having a thickness of between 0.2 mm and approximately 1.2 mm, and ideally between 0.35 mm and around 1 mm.

Figure 2:
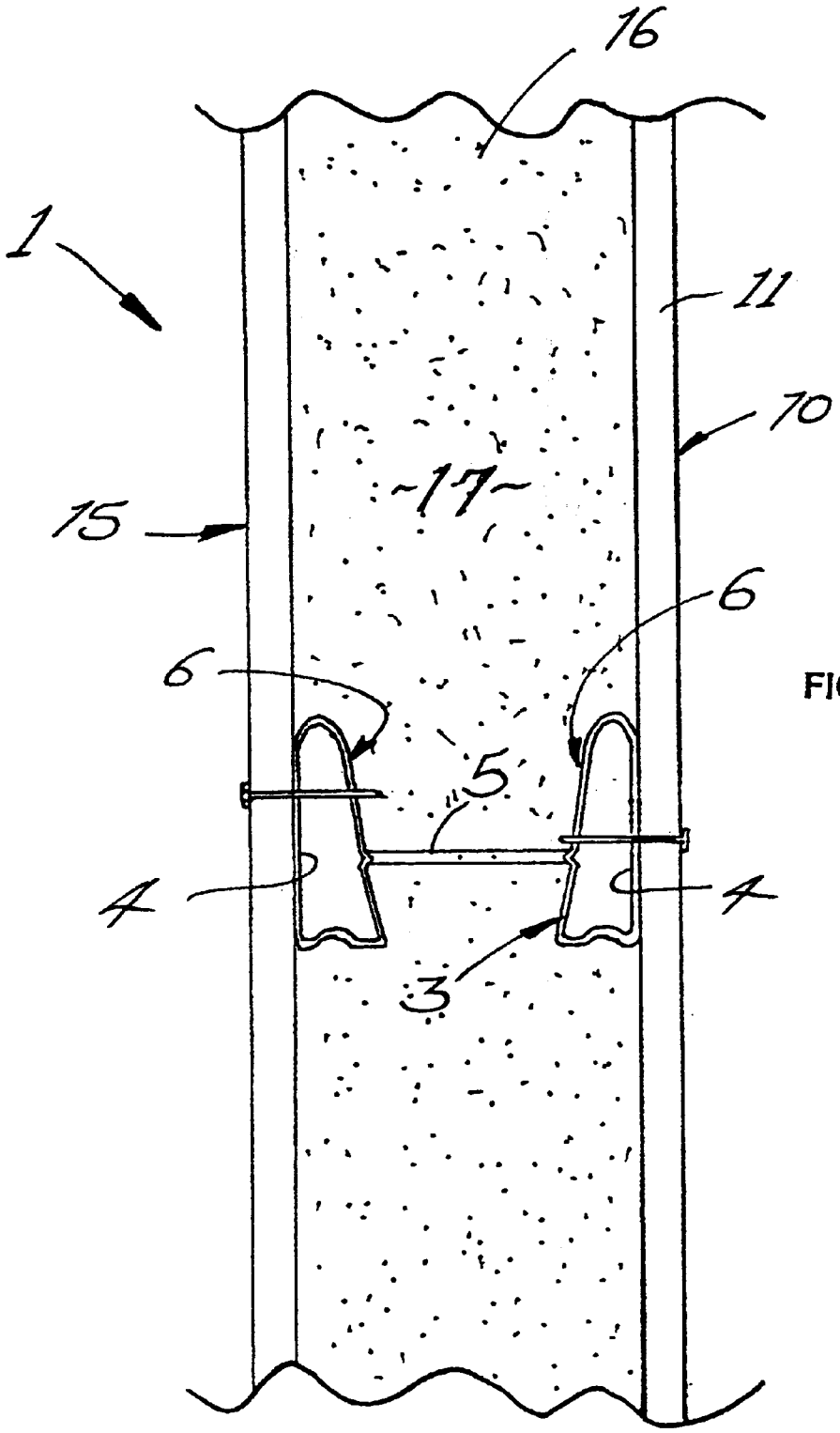
FIG. 2 is an enlarged cross-sectional view showing part of the wall section of FIG. 1 including a first embodiment framing stud.
Figure 3:
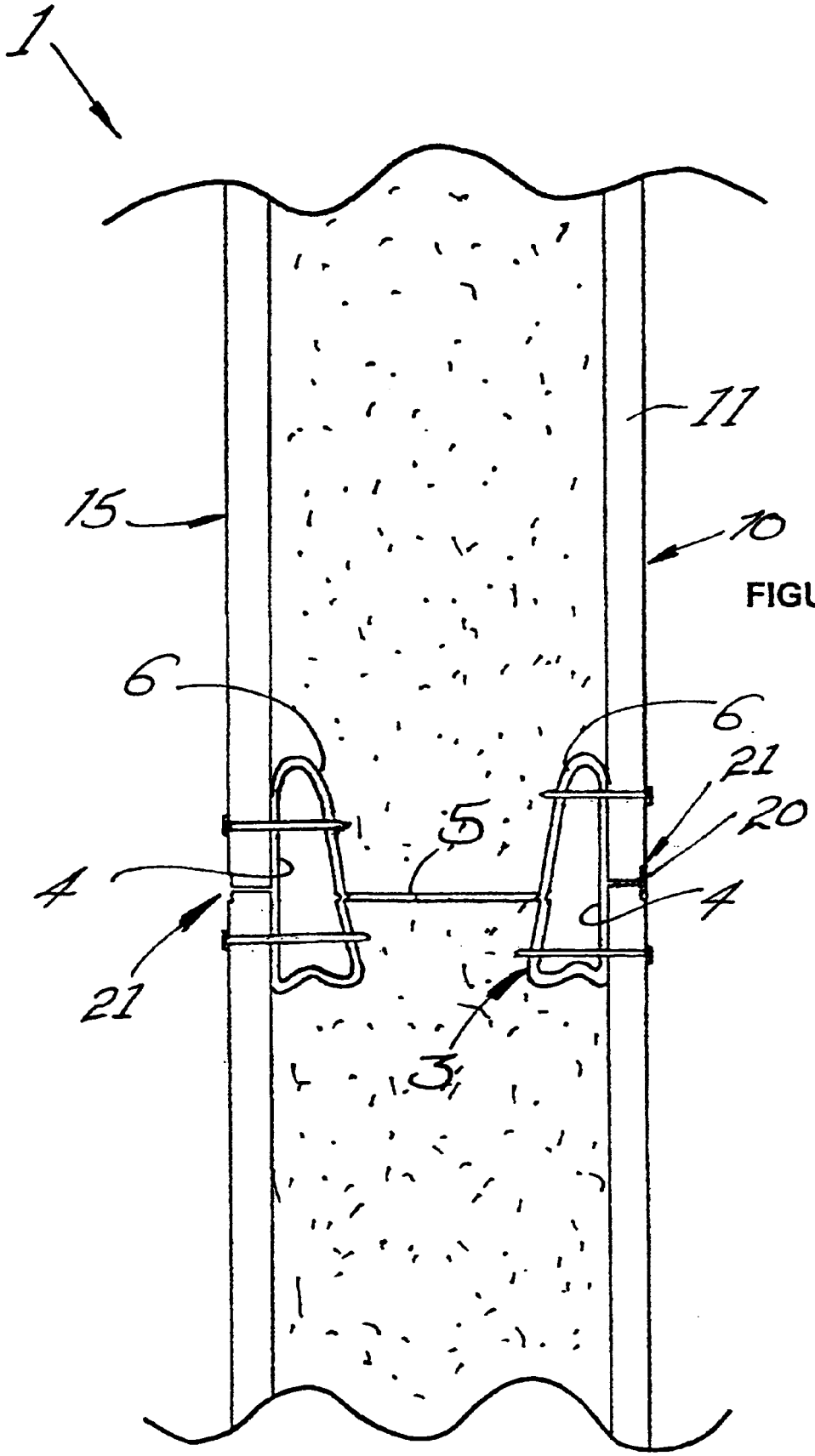
FIG. 3 is a cross-sectional view similar to FIG. 2, illustrating the abutment and attachment of adjoining sheets adjacent a framing stud.

As best seen in FIGS. 2 and 3, the frame members comprise generally U or H-shaped vertically oriented studs 3 having spaced apart edge flanges 4 joined by an intermediate web section 5. In the preferred embodiment, the edge flanges 4 are defined by closed box sections 6 which resist lateral deformation during installation of nails or screws, and enhance overall torsional rigidity. The particular structure illustrated is referred to as a "dog bone" stud.

The vertically oriented studs are joined by generally horizontal connecting members in the form of top plates, 7, and bottom plates 8. The frame members are preferably between 50 mm and 120 mm in width, and ideally approximately 70 mm in width, corresponding to the distance between the flanges 4. The spacing between the studs is ideally around 400 mm. In alternative configurations, however, frame members having different cross-sectional configurations may be used. In particular, square or box sections are contemplated. It should also be appreciated that a range of stud sizes and spacings may be used, to suit particular applications.

With the frame erected, an external layer 10 of cladding material in the form of fibre reinforced sheets 11 is applied to the outer side of the frame. These sheets are preferably between 4 mm and around 15 mm in nominal thickness. It has been found that sheets in this dimensional range represent a reasonable balance between strength, solidity, weight and cost. The fibre reinforced cement sheets are attached by means of nails 12, preferably using a nail gun. The nails ideally penetrate and extend into the adjacent box flanges 4 of the studs 3. An internal layer 15 of lining material, also in the form of fibre reinforced sheets 11, is then applied, again by nails, to the inner side of the frame. Each nail again preferably penetrates both sides of the adjacent box flange, to provide additional grip and hence pull-out strength. Typically, two nails are positioned 50 mm apart, every 300 mm along each stud as best seen in FIG. 1. This arrangement defines a wall cavity 16 bounded by the respective layers of sheet material, and partitioned internally by the intermediate framing studs.

The next step in the first preferred process involves substantially filling the wall cavity with a cementitious material 17, preferably producing a core density of between 200 kg/m$^3$ and around 1200 kg/m$^3$, and ideally around 550 kg/m$^3$. The preferred cementitious formulation comprises a mixture of sand, cement and water, together with suitable additives adapted to achieve the desired density and to facilitate mixed performance and bonding. One particularly preferred formulation includes, within a tolerance of around ±10%, approximately:

45% by weight of cement;

19% by weight of sand;

29.5% by weight of water;

4% by weight of expanded polystyrene beads; and 0.5% by weight of concrete additives.

If desired, the webs of the studs may be formed with spaced apart apertures to allow the flow of cementitious material directly between adjacent sections or compartments within the wall cavity. Alternatively, the separate compartments may be filled individually.

The wall cavity may also be filled partially or entirely with a suitable insulation material such as fibreglass batts, rockwool, expanded polystyrene foam, or the like. It may also be used to accommodate concealed electrical wiring, plumbing, communication lines, air ducting, or other services. The insulation materials and the service lines may be conveniently installed at this stage, if required.

A jointing compound 20 is then preferably applied over the joints 21 between adjacent fibre reinforced cement sheets, as best seen in FIG. 3. The process for finishing joints of this type using standard jointing compounds suitable for the purpose is well known to those skilled in the art, and so will not be described further.

If desired, a layer of textured surface finish (not shown), such as acrylic, cementitious or epoxy based formnulation may also be applied to the outer surface of the external cladding material.

Other sample wall specifications with cavity size, sheet specifications, nail specifications, nail spacing configurations and preferred core densities are exemplified below.

TABLE A

| | |
|---|---|
| Sheet: | • Fibre reinforce sheeting such as Villaboard ™ or Hardiwall ™ .<br>• Thickness range from 4.5 mm to 12 mm but ideally 6 mm–9 mm.<br>• Alternatively Gypsum wall board with sheet thickness range from 10 mm to 16 mm.<br>• All sheets to have the long edges recessed if the wall is to be flush jointed and set. |
| Framing: | • Boxed mounting flange stud ("Dogbone").<br>• Gauge between 0.2 and 1.2 and ideally 0.35 mm to 1 mm.<br>• Stud spacing 300 mm to 600 mm centres.<br>• Stud width between 64 mm and 200 mm but ideally 70 mm to 90 mm (stud width determines cavity size) |

TABLE A-continued

| | |
|---|---|
| Fixing: | • Hardened steel nail with knurled shank (galvanised).<br>• Shank diameter 2 mm to 3.2 mm.<br>• Head diameter 5 mm to 10 mm.<br>• Length 25 mm to 50 mm.<br>• Fastener centres between 100 mm and 300 mm per stud but ideally at 150 mm centres. |
| Core Mix: | • Density between 200 and 1200 kg/m$^3$ and ideally about 550 kg/m$^3$ |

The invention follows in part from the unexpected realisation that by using a relatively high tensile metal in the structural framing elements, nails can be used as an effective fastening mechanism, thereby substantially accelerating the construction process. Without limiting the invention to any specific theoretical analysis, it is believed that the increased "springiness" exhibited by high tensile steel results in the hole produced by the insertion of each nail being marginally smaller than the diameter of the nail itself. The difference in diameter is accommodated by elastic rather than plastic deformation of the metal around the hole. The resultant resilient restoring force of the surrounding metal causes the nail to be actively "gripped" in position. By contrast, when conventional mild steel framing elements are used, penetration by nails produces a hole which is at least the same diameter as, and often marginally larger than, that of the nail. As a result, the effective resistance to an applied pull-out force is minimal, and the nail is ineffective as a fastening element.

It has also been discovered that surprisingly staples can also be used as a potentially even more effective substitute for nails, the operation of which will be described hereafter in more detail in reference to the second preferred application relating to dry wall structures. In the meantime other sample filled wall specifications defining cavity size, sheet specifications and staple specifications and staple spacing configurations are exemplified below.

TABLE B

| | |
|---|---|
| Sheet: | • Fibre reinforced sheeting such as Villaboard ™ Hardiwall ™ .<br>• Thickness range from 4.5 mm to 12 mm but ideally 6 mm–9 mm.<br>• Alternatively Gypsum wall board with sheet thickness range from 10 mm to 16 mm.<br>• All sheets to have the long edges recessed if the wall is to be flush jointed and set. |
| Framing: | • Boxed mounting flange stud ("Dogbone").<br>• Gauge between 0.2 and 1.2 and ideally 0.35 mm to 1 mm.<br>• Stud spacing 300 mm to 600 mm centres.<br>• Stud width between 64 mm and 200 mm but ideally 70 mm to 90 mm (stud width determines cavity size). |
| Fixing: | • Steel staples (galvanised).<br>• Crown width 5 mm to 20 mm<br>• Gauge 0.8 mm to 2 mm<br>• Length 25 mm to 50 mm<br>• Fastener centres between 100 mm and 300 mm per stud but ideally at 150 mm centres. |
| Core Mix: | • Density between 200 and 1200 kg/m$^3$ and ideally about 550 kg/m$^3$. |

The first preferred application of the invention to filled partition structures thus provides a construction technique which makes efficient use of materials in a manner which is cost effective in comparison with conventional building techniques, and provides the feeling of solidity conferred by masonry construction. At the same time, the use of self piercing impact fasteners such as nails or staples to quickly secure the cladding sheets which has hitherto not been viable with conventional metal framing elements use in such applications, provides a significant reduction in overall o construction time and therefore labour cost. In these and other respects, the invention represents a commercially significant improvement over the prior art.

Figure 4:
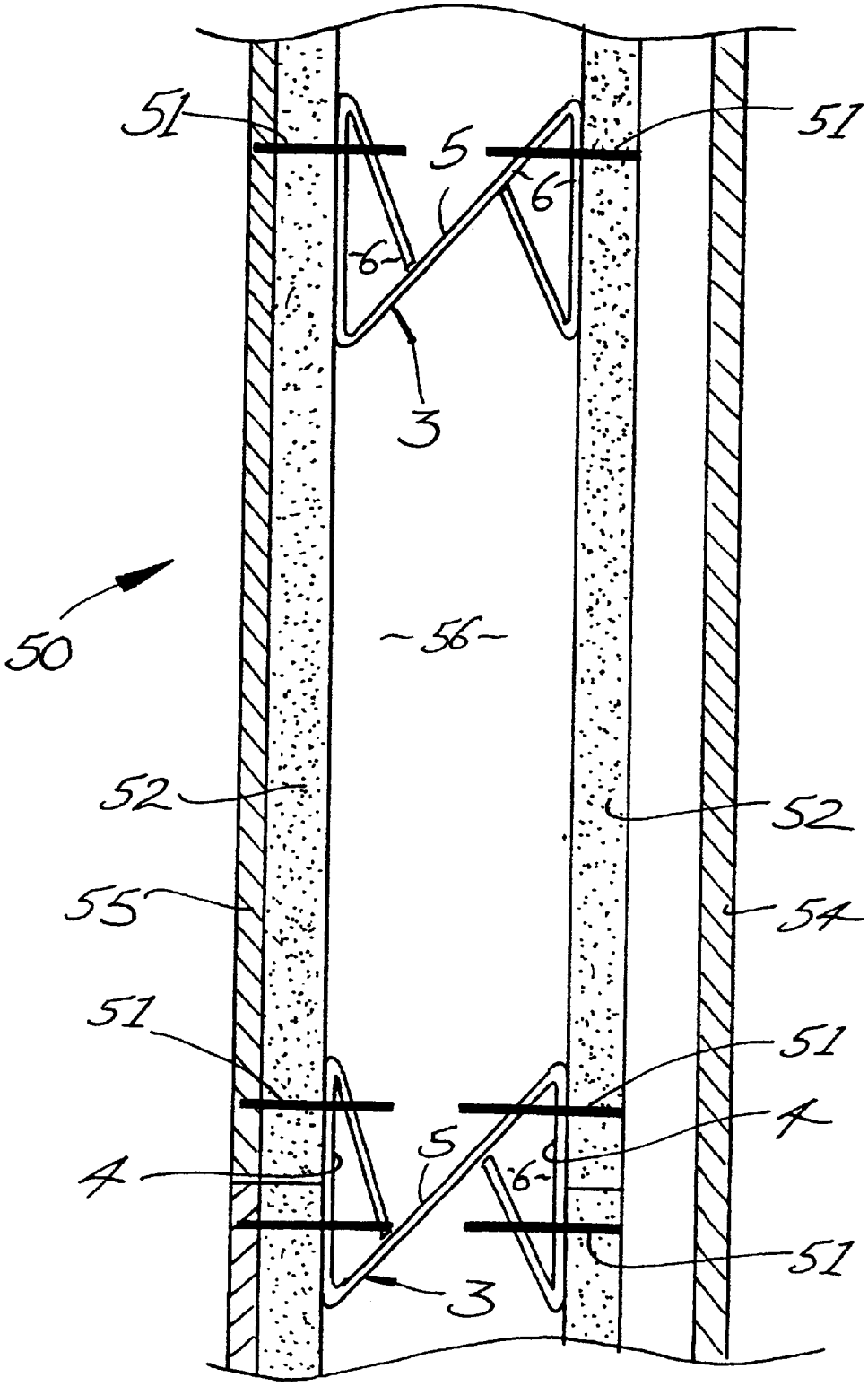
FIG. 4 is a cross-sectional view of a first embodiment dry wall formed in accordance with the method of the second preferred application of the invention illustrating first embodiment staples being used to secure cladding to a second embodiment boxed '2' section framing stud.

Turning next to FIG. 4, there is shown a dry wall 50 made in accordance with the method of the second preferred application of the invention, which, it will be appreciated, is similar in many respects to the first application. Accordingly, wherever possible like reference numerals will be used to denote corresponding features.

The dry wall 50 include a plurality of frame members or studs 3 having spaced apart end flanges 4 joined by an intermediate web section 5. In the embodiment illustrated, the studs are generally "Z" shaped in cross section with closed in boxed sections 6. As with the "dog bone" stud of the previous embodiment, the box sections 6 resist lateral deformation during application of the impact fasteners and enhance overall torsional rigidity. It should be noted that the "dog bone" stud of the previous embodiment or indeed other structurally similar sections are equally applicable to the dry wall application currently being described.

Once the frame has been erected, cladding is applied to the frame work preferably using staples 51 driven by a suitably powered staple gun. The embodiment illustrated has been configured to provide a predetermined fire resistance and comprises on one side a first layer of fire grade gypsum wall board underlay 52. This underlay is secured directly to the studs 3 by means of parallel pronged staples 51 which penetrate through two surfaces of the stud as shown. A service cavity 53 is also provided which is enclosed by suitable means by a single layer of facing material 54 which may comprise a fibre reinforced cementitious board or the like.

On the other side of the structure, a second sheet of fire grade gypsum wall board underlay with an overlaid face layer 55, which may be pre-attached to the underlay if required, are both simultaneously secured to the studs 3 with staples that penetrate both is sheets and the stud.

It will be appreciated that in accordance with known variations applicable to the construction of dry walls of this kind, a wide variety of different combinations of materials can be used depending on the specified performance and purpose of the wall structure. This may also include the incorporation of acoustic or thermal insulation within the wall cavity 56.

Other sample dry wall specifications defining cavity size, sheet specifications and staple specifications are exemplified below.

TABLE C

| | |
|---|---|
| Sheet: | • Fire rated Gypsum board 10 mm to 16 mm in thickness fastened to frame and overlaid with 6 mm to 9 mm fibre reinforced cement sheeting.<br>• Joints between adjacent sheet layers are usually offset. |
| Framing: | • Boxed mounting flange stud ("Dogbone").<br>• Gauge between 0.2 and 1.2 and ideally 0.35 mm to 1 mm.<br>• Stud spacing 300 mm to 600 mm centres.<br>• Stud width between 64 mm and 200 mm but ideally 70 mm to 90 mm (stud width determines cavity size). |
| Fixing: | • Steel staples (galvanised); or<br>  • Crown width 5 mm to 20 mm<br>  • Gauge 0.8 mm to 2 mm<br>  • Length 25 mm to 50 mm<br>• Hardened steel nail with knurled shank (galvanised).<br>  • Shank diameter 2 mm to 3.2 mm.<br>  • Head diameter 5 mm to 10 mm.<br>  • Length 25 mm to 50 mm.<br>• Fastener centres between 100 mm and 300 mm per stud but ideally at 150 mm centres. |

It has been found that the use of staples in both preferred applications, whilst being as fast and efficient to use as nails, also offers further unexpected advantages. For example, it has been found that the depth of penetration of the staple into the cladding material can be more accurately controlled and is more consistent than is generally achievable with nails. Further, the staples are significantly less costly than the special knurled shank hardened steel nails that are required for applications of this kind.

Figure 5:
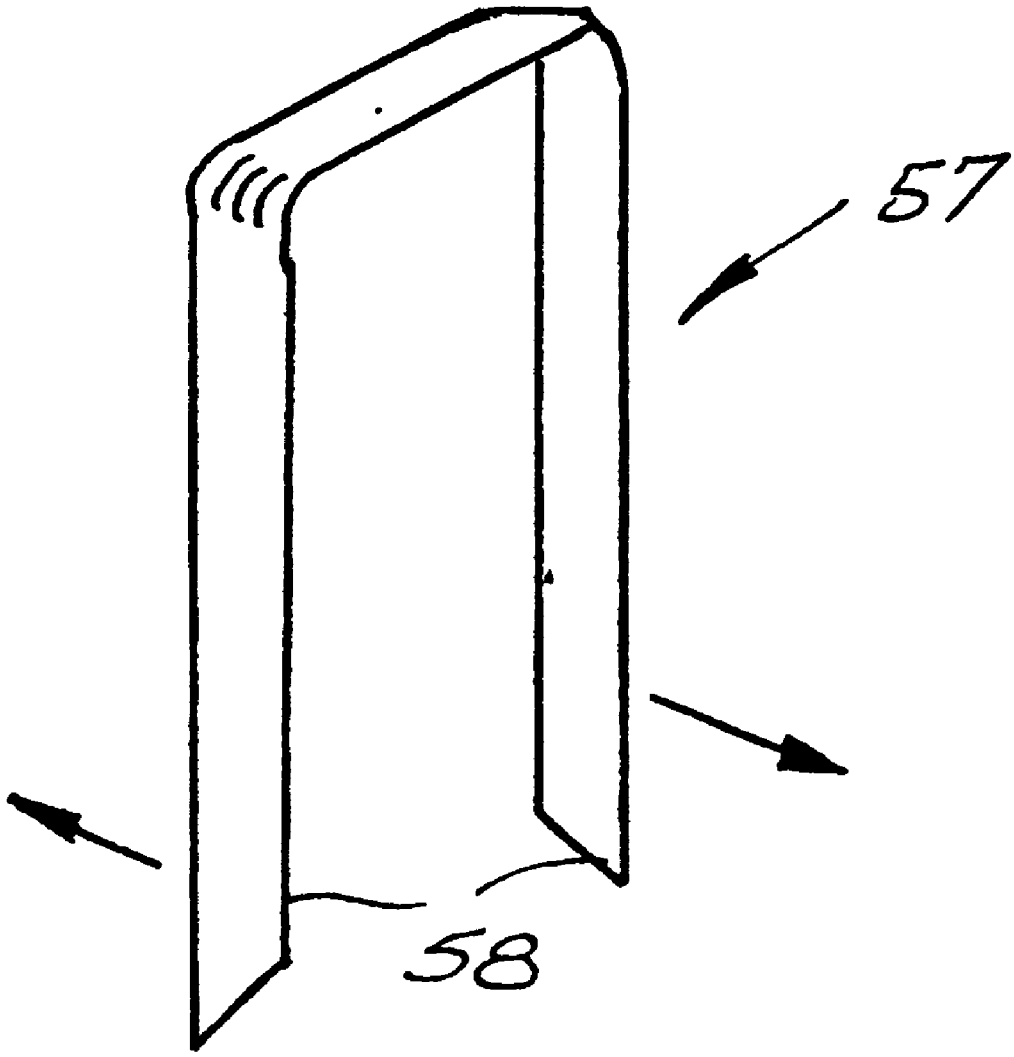
FIG. 5 is an enlarged perspective view of a second embodiment diverging staple suitable for use in connecting a sheet member to a frame-member in accordance with the invention.

It has also been observed that the interconnection of the two prongs of the staple by the bridging member appears to apply a transverse load to the spaced prongs thereby increasing the pull out resistance compared to, say, two nails of similar cross-section. This effect is further enhanced by the use of special staples 57 with acute end cut prongs or tines 58 that are set to diverge upon penetration through the stud material (as shown in FIG. 5). This suggests that penetration of the staple through two layers of the stud member is less likely to be needed than may be the case for equivalently sized nails.

Although the invention has been described with reference to specific examples, it will be appreciated by those skilled in the art, that the invention may be embodied in many other forms.

What is claimed is:

1. A method of partition construction, said method including the steps of:

erecting a support frame from spaced apart frame members having boxed mounting flanges that each define an outer flange and an inner flange spaced inwardly therefrom;

applying a layer of solid sheet material to at least one side of the frame so as to abut said outer flange; and securing said layer of solid sheet material to the frame by means of self-piercing staples each having at least two prongs, wherein each prong of each staple is driven to self pierce and extend through the solid sheet material and both said outer flange and spaced inner flange of the adjacent boxed mounting flange of the frame member.

2. The method of partition construction according to claim 1, wherein the erecting the support frame step comprises erecting frame members at a center spacing of 300 mm to 600 mm.

3. The method of partition construction according to claim 1, wherein the securing said layer step is performed by a powered gun or driver.

4. The method of partition construction according to claim 1, wherein the securing said layer step further comprises the step of driving staples at between 100 mm and 300 mm centers.

5. The method of partition construction according to claim 1, wherein the securing said layer step further comprises controlling the depth of penetration of the staple through the outer surface of the sheet material.

6. The method of partition construction according to claim 5, wherein the controlling the depth of penetration step comprises recessing the staple into the material.

7. The method of partition construction according to claim 1, further comprising the step of scouring an additional layer of sheet material to the opposite side of the frame.

8. The method of partition construction according to claim 1, further comprising the step of securing or overlaying additional layers of sheet materials.

9. The method of partition constriction according to claim 8, wherein the step of securing additional layers comprises securing gypsum board or fiber reinforced sheeting.

10. The method of partition construction according to claim 1, further comprising the step of applying a jointing compound over abutting edges of adjacent sheet material to conceal the joints.

11. A method of construction of a solid filled wall or partition, said method including the steps of:

erecting a support frame from spaced apart frame members having boxed mounting flanges that each define an outer flange and an inner flange spaced inwardly therefrom;

applying an inter layer of solid sheet material to an inner side of the tame and applying an external layer of solid sheet material to an outer side of the frame thereby defining a wall cavity between said internal and external layers of solid sheet material;

securing said internal and external layers of solid sheet material to the frame by means of self-piercing staples having at least two prongs, wherein each prong of each staple is driven to self pierce and extend through the sheet material and both said outer flange and said spaced inner flange of the adjacent boxed mounting flange of the frame member; and filling the wall cavity formed between said internal and external layers of solid sheet material with a cementitous material.

12. The method of partition construction according to claim 11, wherein the erecting the support fame step comprises erecting frame members at a center spacing of 300 mm to 600 mm.

13. The method of partition construction according to claim 11, wherein the securing said layer step is performed by a powered gun or driver.

14. The method of partition construction according to claim 11, wherein the securing said layer step further comprises the step of driving staples at between 100 mm and 300 mm centers.

15. The method of partition construction according to claim 11, wherein the sercuring said layer step further comprises controlling the depth of penetration of staple through the outer surface of the sheet material.

16. The method of partition construction according to claim 15, wherein the controlling the depth of penetration step further comprises recessing the staple into the material.

17. The method of partition construction according to claim 11, further comprising the step of securing or overlaying additional layers of sheet materials.

18. The method of partition construction according to claim 17, wherein the step of securing additional layers comprises securing gypsum board or fiber reinforced sheeting.

19. A method of construction of a solid filled partition, said method including the steps of:

erecting a support frame from spaced apart frame members having boxed mounting flanges that each define an outer flange and an inner flange spaced inwardly therefrom;

applying an internal layer of solid sheet material to an inner side of the frame;

applying an external layer of solid sheet material to an outer side of the frame thus forming a wall cavity between said internal layer and said external layer;

securing said internal and external layers of sheet material to the frame by means of self-piercing impact fasteners, wherein said fasteners pierce and extend through both said outer flange and said spaced inner flange of the adjacent boxed mounting flange of the frame member; and filling the wall cavity with a cementitous material.

20. The method of partition construction according to claim 19, wherein the erecting the support frame step comprises erecting frame members at a center spacing of 300 mm to 600 mm.

21. The method of partition construction according to claim 19, wherein the securing said layer step is performed by a powered gun or driver.

22. The method of partition construction according to claim 19, wherein the securing said layer step further comprises the step of driving fasteners at between 100 mm and 300 mm centers.

23. The method of partition construction according to claim 19, wherein the securing said layer step further comprises controlling the depth of penetration of the fasteners through the outer surface of the sheet material.

24. The method of partition construction according to claim 19, wherein the controlling the depth of penetration step further comprises recessing the fasteners into the material.

25. The method of partition construction according to claim 19, further comprising the step of securing or overlaying additional layers of sheet materials.

26. The method of partition construction according to claim 25, wherein the step of securing additional layers comprises securing gypsum board or fiber reinforced sheeting.

27. The method of partition construction according to claim 19, further comprising the step of applying a jointing compound over abutting edged of adjacent sheet material to conceal the joints.

28. A partition or wall construction system, comprising:

a support fame comprising spaced apart frame members having boxed mounting flanges that each define a solid outer flange and a solid inner flange spaced inwardly therefrom, the frame members being formed from a metal having a relatively high tensile strength;

a layer of solid sheet material attached to one side of the frame so as to abut said outer flange; and a plurality of self piercing staples each having two prongs pierced and extended through said layer of solid sheet material and both said solid outer flange and spaced solid inner flange of the adjacent boxed mounting flange of the frame member.

29. The partition or wall construction system of claim 28, wherein the frame is erected from frame members in which the external flange of the frame member is configured to extend transversely to the direction of penetration of the self piercing staples and the internal flange is inclined thereto.

30. The partition or wall construction system of claim 28, wherein the staple prongs are configured to diverge upon penetration.

31. The partition or wall construction system of claim 28, wherein the staples are applied using a powered gum or driver.

32. The partition or wall construction system of claim 28, wherein the staples are formed of hardened galvanized steel.

33. A partition or wall construction system, comprising:

a support frame comprising spaced apart frame members having boxed mounting flanges that each define a solid outer flange and a solid inner flange space inwardly therefrom;

an internal layer of solid sheet material affixed to an inner side of the frame by self piercing staples having two or more prongs and wherein each prong is self pierced and extended through the sheet material and both said solid outer flange and said spaced solid inner flange of the adjacent boxed mounting flange of the frame member;

an external layer of solid sheet material affixed to an outer side of the frame by self piercing staples having two or more prongs and wherein each prong is self pierced and extended through the sheet material and both said solid outer flange and said spaced solid inner flange of the adjacent boxed mounting flange of the frame member; and a cementitous material substantially filling a cavity formed between said internal layer of solid sheet material and said external layer of solid sheet material.

34. The partition or wall construction system of claim 33, wherein the cementitous material includes additives selected to provide an overall core density of between 200 kg/m$^3$ and 1200 kg/m$^3$.

35. The partition or wall construction system of claim 34, wherein the cementitous material has a core density of about 550 kg/m$^3$.

36. The partition or wall construction system of claim 33, wherein the cementitous material is a concrete formulation.

37. The partition or wall construction system of claim 33, wherein the concrete formulation includes:

30% to 60% by weight of cement;

10% to 30% by weight of sand;

20% to 40% by weight of water;

1% to 10% by weight of expanded polystyrene beads; and

1% to 5% by weight of concrete additives.

38. The partition or wall construction system of claim 33, wherein the solid sheet material is a fiber reinforced cement sheet having a relatively low permeability.

39. The partition or wall construction system of claim 33, wherein the solid sheet material is a cement bonded particle board.

40. The partition or wall construction system of claim 33, wherein a jointing compound is applied over abutting edges of adjacent sheet material to conceal the joints.

41. The partition or wall construction system of claim 33, wherein the staples are made from galvanized steel.

42. The partition or wall construction system of claim 33, wherein the crown width of tie staples is between 5 mm and 20 mm, the thickness or gauge is 0.8 mm to 2 mm and the length of the staple prongs or tines is about 25 mm to 50 mm.

43. The partition or wall construction system of claim 33, wherein the staples arc secured at centers of between 100 mm and 300 mm.

44. The partition or wall construction system of claim 43, wherein the staples are secured at approximately 150 mm centers.

45. The partition or wall construction system of claim 33, wherein the solid sheets are secured with staples having acute ended prongs configured to diverge on penetration.

46. A solid filled partition, comprising:

a support frame having spaced apart frame members having boxed mounting flanges that each define a solid outer flange and a solid inner flange spaced inwardly therefrom;

an internal layer of solid sheet material affixed to an inner side of the frame by self-piercing impact fasteners pierced and extended through the sheet material and both said solid outer flange and said spaced solid inner flange of the adjacent boxed mounting flange of the frame member;

an external layer of solid sheet material affixed to an outer side of the frame by self-piercing impact fasteners pierced and extended through the sheet material and both said outer solid flange and said spaced solid inner flange of the adjacent boxed mounting flange of the frame member; and a cementitous material substantially filling a cavity formed between said internal layer of solid sheet material and said external layer of solid sheet material.

47. The partition or wall construction system of claim 46, wherein the cementitous material includes additives selected to provide an overall core density of between 200 kg/m$^3$ and 1200 kg/m$^3$.

48. The partition or wall construction system of claim 46, wherein the cementitous material has a core density of about 550 kg/m$^3$.

49. The partition or wall construction system of claim 46, wherein the cementitous material is a concrete formulation.

50. The partition or wall construction system of claim 46, wherein the concrete formulation includes:

30% to 60% by weight of cement;

10% to 30% by weight of sand;

20% to 40% by weight of water;

1% to 10% by weight of expanded polystyrene beads; and

1% to 5% by weight of concrete additives.

51. The partition or wall construction system of claim 46, wherein the solid sheet material is a fiber reinforced cement sheet having a relatively low permeability.

52. The partition or wall construction system of claim 46, wherein the solid sheet material is a cement bonded particle board.

53. The partition or wall construction system of claim 46, wherein a jointing compound is applied over abutting edges of adjacent sheet material to conceal the joints.

54. The partition or wall construction system of claim 46, wherein the impact fasteners are made from galvanized hardened steel.

55. The partition or wall construction system of claim 46, wherein the impact fasteners are staples.

56. The partition or wall construction system of claim 55, wherein the crown width of the staples is between 5 mm and 20 mm, the thickness or gauge is 0.8 mm to 2 mm and the length of the staple prongs or tines is 25 mm to 50 mm.

57. The partition or wall construction system of claim 56, wherein the staples are secured at centers of between 100 mm and 300 mm.

58. The partition or wall construction system of claim 57, wherein the staples are secured at approximately 150 mm centers.

59. The partition or wall construction system of claim 55, wherein the solid sheets are secured with staples having acute ended prongs configured to diverge on penetration.

* * * * *

UNITED STATES PATENT AND TRADEMARK OFFICE

CERTIFICATE OF CORRECTION

PATENT NO. : 6,688,066 B1
DATED : February 10, 2004
INVENTOR(S) : Cottier et al.

It is certified that error appears in the above-identified patent and that said Letters Patent is hereby corrected as shown below:

Column 12,
Line 36, please delete “scouring” and insert therefore, -- securing --.
Line 40, please delete “constriction” and insert therefore, -- construction --.
Line 54, please delete “tame” and insert therefore, -- frame --.

Column 13,
Line 2, please delete “fame” and insert therefore, -- frame --.
Line 12, please delete “sercuring” and insert therefore, -- securing --.

Column14,
Line 6, please delete “fame” and insert therefore, -- frame --.

Signed and Sealed this

Tenth Day of August, 2004

JON W. DUDAS
*Acting Director of the United States Patent and Trademark Office*